United States Patent [19]

Becker

[11] 4,271,992

[45] Jun. 9, 1981

[54] TAP FOR DISPENSING BEVERAGES

[76] Inventor: Carl M. Becker, Kalkstrasse 1b, 4030 Ratingen 4, Fed. Rep. of Germany

[21] Appl. No.: 94,208

[22] Filed: Nov. 14, 1979

[30] Foreign Application Priority Data

Nov. 27, 1978 [DE] Fed. Rep. of Germany ..... 2851182

[51] Int. Cl.[3] ..... B67D 3/00

[52] U.S. Cl. ..... 222/509; 222/518; 251/354; 138/40

[58] Field of Search ..... 222/509, 505, 501, 511, 222/518, 559; 138/40, 44; 251/339, 354, 149.1, 149.6

[56] References Cited

U.S. PATENT DOCUMENTS

| | | | |
|---|---|---|---|
| 2,234,816 | 3/1941 | Anagno | 138/40 |
| 2,389,297 | 11/1945 | Crevatin et al. | 251/354 |
| 3,252,633 | 5/1966 | Clarke | 222/564 |
| 3,715,099 | 2/1973 | Shendure | 251/149.6 |

*Primary Examiner*—H. Grant Skaggs
*Attorney, Agent, or Firm*—Sherman & Shalloway

[57] ABSTRACT

A beverage dispensing tap of the type wherein a compensator sleeve inside the housing maintains a shut-off valve open for supply of the beverage into the housing of the tap. The invention simplifies the structure of the tap by replacing a number of sealing rings at the inlet of the housing by a single gasket which seals the compensator sleeve against the housing, provides valve seat for the shut-off valve and also serves as a seal at a union connecting the inlet of the housing to a connection pipe for feeding the beverage into the housing.

25 Claims, 1 Drawing Figure

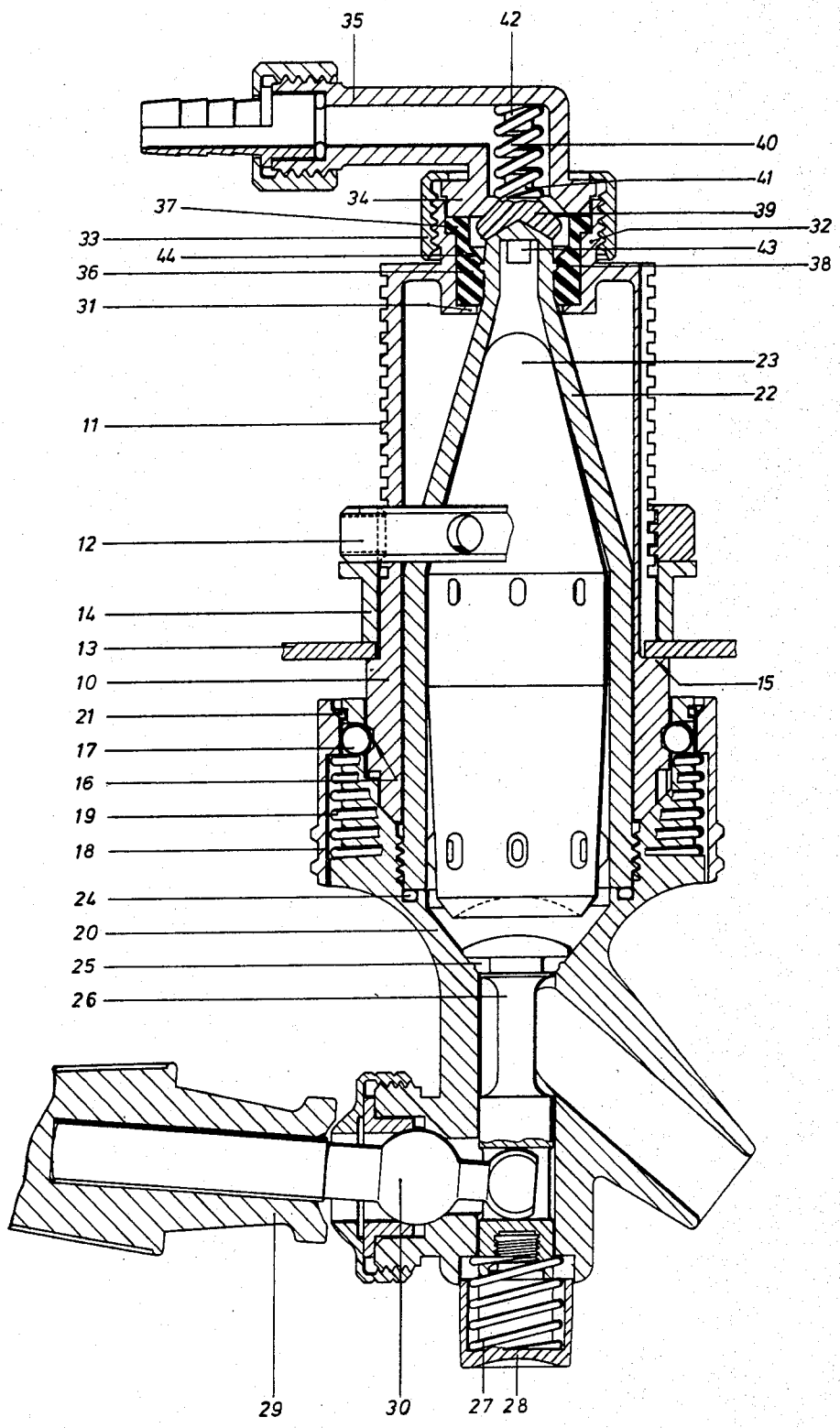
35
42
40
41
34
37
39
32
33
44
43
36
38
31
23
22
11
12
14
13
10
15
21
17
16
19
18
24
20
25
26
29
30
27
28

TAP FOR DISPENSING BEVERAGES

BACKGROUND OF THE INVENTION

The present invention relates to a tap for dispensing beverages, particularly for dispensing non-alcoholic, carbonated beverages delivered to the tap under pressure. The tap is of the type comprising a housing with an inlet end and a discharge end. A dispensing valve head is releasably secured at the outlet of the housing. The tap further includes a compensating sleeve disposed inside of said housing and surrounding a compensator member, a releasable connecting pipe being secured to a union portion at the inlet end of the housing for supplying the beverage to same. The compensating sleeve is removable simultaneously with the compensator member upon release of the dispensing valve head at the discharge end of the housing. The tap further comprises a shut-off valve disposed in proximity to the connecting pipe and movable by displacing within said housing the compensating sleeve such that the closing member or portion of the shut-off valve is urged, upon removal of the compensator sleeve, by a spring against a valve seat, to shut off the supply of the beverage to the housing.

In known types of a tap of this kind, the compensating sleeve engages directly an inwardly turned annular shoulder integral with the housing. Such area of contact is provided with a first sealing ring to secure an appropriate leak-proof connection between the compensating sleeve and the housing of the tap.

When the shut-off valve is in a closed state, the closing portion of the valve engages a conical sealing surface integral with the housing. At such location, it is necessary to provide a second sealing ring in order to secure the desired tightness of the closed valve.

Finally, a still further sealing means is required in order to provide a leak-proof arrangement between the connecting pipe itself relative to the union portion of the housing.

The number of the required sealing areas of the tap not only gives rise to relatively high manufacturing costs. The cleaning and maintaining of the tap in a clean condition is relatively difficult.

Accordingly, it is an object of the present invention to provide a tap of the type as referred to above which would be improved in that while the desired sealing effects are achieved, technological requirements for the production of the tap are reduced. Another object is to facilitate the cleaning of the tap and the maintaining of same in a clean state.

SUMMARY OF THE INVENTION

In general terms, the present invention provides a tap for dispensing beverages, particularly for dispensing non-alcoholic beverages delivered to the tap under pressure, said tap being of the type comprising a housing having a dispensing valve head secured to an outlet end of the housing, said tap further comprising a compensating sleeve surrounding a compensator and disposed inside said housing, said compensating sleeve being arranged for receiving a flow of the beverage at an inlet end of the housing, over a releasable connecting pipe secured to a union portion of the housing, said compensating sleeve being arranged such that it is removable from said housing together with the compensator after release of the dispensing valve head at the outlet end of the housing, said tap being provided with a shut-off valve at the union portion of said housing, said shut-off valve being arranged to be opened by inserting said compensating sleeve into said housing, said shut-off valve having a closure member operatively associated with a spring urging the closure portion of the valve against a valve seat upon withdrawal of the compensating sleeve from the housing, wherein the valve seat is formed as a part of the gasket means disposed at said union portion of the housing, the gasket means being disposed such that an upstream end portion of the compensating sleeve passes through the gasket means when the dispensing valve head is secured to the housing, said gasket means being operative to simultaneously provide a generally leak proof seal between the compensating sleeve and the housing.

The gasket means preferably abuts against the inwardly turned annular flange of the union portion of the housing. According to another feature of the present invention, the upstream end portion of the compensating sleeve is provided with an annular peripheral protrusion for engagement with a complementary groove provided in the gasket means for maintaining a locking engagement between the compensating sleeve and the gasket means. In accordance with yet another feature of the present invention, the connecting pipe is provided with a union flange insertable into the union portion of the housing, said union flange being arranged to sealingly engage said gasket means at an upstream face thereof. The closure member of the shut-off valve means may be provided with an upstream directed protrusion to which the spring is grippingly secured. According to a yet further feature to the present invention, the connecting pipe includes an elbow section, the spring being disposed within a downstream end of the connecting pipe and abutting against said connection pipe at the interior thereof near the elbow section. In accordance with a further feature of the present invention, the interior of the connecting pipe near said elbow section is also provided with a protrusion to which the spring is grippingly secured.

DESCRIPTION OF PREFERRED EMBODIMENT

A preferred embodiment of the present invention will now be described in greater detail with reference to the accompanying drawing showing a longitudinal section of a tap.

It has a housing 10 provided with an exterior thread 11 on which is threaded an annular nut 12. The annular nut 12 serves the purpose of securing the tap to a mounting surface 13 of a dispensing device, not shown. Between the mounting flange 13 and the annular nut 12 is arranged a supporting ring 14. The housing 10 is provided with an annular shoulder 15 which abuts against a lower surface of the mounting flange 13.

At the lower, outlet end, the housing 10 is provided with an annular groove 16 in which are disposed balls 17 of a quick-release device. The latter includes a locking sleeve 18, which can be displaced downwards against the action of a spring 19. When the locking sleeve assumes its lowermost position, the balls 17 can exit radially outwardly from the peripheral groove 16 to allow withdrawal of the valve head 20 of the tap downwardly. The locking sleeve 18 is provided at its upper end with an inserted ring 21 which encloses the end of the sleeve to prevent escape of balls 17 from the groove 16 when the locking sleeve 18 is in its upper position.

In the dispensing valve head 20 is threaded the lower end of a compensating sleeve 22 which contains a compensator 23 and is sealed relative to the dispensing valve head 20 by means of an annular seal 24.

The dispensing valve head 20 includes a closure member 26 provided with a sealing disc 25, operatively associated with a closing spring 27 such that the spring 27 maintains the closure member 26 in a closed position. Thus, the closing spring 27, which is supported on the dispensing valve head 20, urges a cap 28 operatively associated with the closure member, downwards. In order to move the closing member 26, a handle 29 is provided which is operatively connected with the dispensing valve head 20 over a ball joint 30.

The compensating sleeve 22 decreases in its cross-sectional size in the upward direction and passes through an inwardly turned annular flange 31 of the upper portion of the housing, which is of the type of a union portion 32. A union nut 33 is threaded on the union portion 32 and abuts against an outwardly turned union flange 34 of a connecting pipe 35 which is bent to form an elbow.

In the union portion 32 is disposed a generally cylindric gasket 36 made from an elastic material and disposed such that its lower face engages the inwardly turned flange 31, while an outwardly turned annular flange 37 of the gasket is in engagement with a correspondingly formed annular shoulder in the connecting portion 32. The annular flange 37 of the sealing element 36 is also fixedly supported from the bottom end so that it serves simultaneously as a tight sealing element for the union flange 34 of the connecting pipe 35, pressed against the gasket by the action of the union nut 33.

The compensating sleeve 22 is provided at its upper end with an outwardly turned peripheral protrusion 38 which snaps into a complementary annular groove in the gasket 36, so that the two are firmly secured to each other to prevent relative movement of the two in axial direction.

The upper face of the compensating sleeve 22 is slightly conical and forms an engagement portion for a closing element 39. The latter is pressed by a spring 40 against the engagement portion of the compensating sleeve 22. The spring 40 itself is grippingly placed over a protrusion 41 projecting upwardly from the closure member 39. The upper end of the spring is also grippingly secured to a projection 42 disposed at the interior of the elbow section of the connection pipe 35. Due to the gripping arrangement between the protrusion 41 and projection 42 and the respective ends of the spring 40, the closing element 39 remains secured to the connecting pipe 35 by the spring 40 even when the union nut 33 has been loosened and the connection pipe 35 removed from the engagement with the housing 10.

Thus, in the operative position shown in the drawing, the compensating sleeve 22 presses the closure member 39 upwards so that the beverage supplied through the connecting pipe 35 can pass over the closure member 39 and through passages 43 at the upper end of the compensating sleeve 22, to the interior of the sleeve. The stream of the beverage then reaches the compensator 23 and therefrom flows towards the closure member 26 of the dispensing valve head 20.

When the dispensing valve head 20 is released by manipulating the locking sleeve 18, it is possible to remove, together with the head, the compensating sleeve 22 with the compensator body 23, by withdrawing same downwards. In so doing, the spring 40 presses the closure member 39 against a conical valve seat 44 provided at the interior of the gasket 36, so that the valve shuts off the passage of the beverage to the housing.

After release of the union nut 33 (which will normally follow the closing of the beverage flow into the connecting pipe 35 by closing means upstream of the connecting pipe 35—not shown), the connecting pipe 35 can be removed from the housing 10 in a simple way. The gasket 36 can then be removed for cleaning or replacement in a convenient way.

Those skilled in the art will appreciate that many modifications of the preferred embodiment may exist, without departing from the scope of the present invention as recited in the accompanying claims.

I claim:

1. A tap for dispensing beverages, particularly for dispensing non-alcoholic carbonated beverages delivered to the tap under pressure, said tap being of the type comprising a housing having a dispensing valve head secured to an outlet end of the housing, said tap further comprising a compensating sleeve surrounding a compensator and disposed inside said housing, said compensating sleeve being arranged for receiving a flow of the beverage at an inlet end of the housing, over a releasable connecting pipe secured to a union portion of the housing, said compensating sleeve being arranged such that it is removable from said housing together with the compensator after release of the dispensing valve head at the outlet end of the housing, said tap being provided with a shut-off valve at the union portion of said housing, said shut-off valve being arranged to be opened by inserting said compensating sleeve into said housing, said shut-off valve having a closure member operatively associated with a spring urging the closure portion of the valve against a valve seat upon withdrawal of the compensating sleeve from the housing, wherein the valve seat is formed as a part of gasket means disposed at said union portion of the housing, the gasket means being disposed such that an upstream end portion of the compensating sleeve passes through the gasket means when the dispensing valve head is secured to the housing, said gasket means being operative to simultaneously provide a generally leak proof seal between the compensating sleeve and the housing.

2. A tap according to claim 1, wherein the gasket means abuts agaist an inwardly turned annular flange of the union portion of the housing.

3. A tap according to claim 1 or 2, wherein the upstream end portion of the compensating sleeve is provided with an annular peripheral protrusion for engagement with a complementary groove provided in the gasket means for maintaining a locking engagement between the compensating sleeve and the gasket means.

4. A tap according to claims 1 or 2 wherein the connecting pipe is provided with a union flange insertable into the union portion of the housing, said union flange being arranged to sealingly engage said gasket means at an upstream face thereof.

5. A tap according to claim 1 or 2, wherein the closure member of the shut-off valve is provided with an upstream directed protrusion to which the spring is grippingly secured.

6. A tap according to claims 1 or 2, wherein the connecting pipe includes an elbow section, the spring being disposed within a downstream end of the connecting pipe and abutting against said connection pipe at the interior thereof near the elbow section.

7. A tap according to claims 1 or 2, wherein:

(a) the connecting pipe includes an elbow section, the spring being disposed within a downstream end of the connecting pipe and abutting against said connection pipe at the interior thereof near the elbow section; and (b) the interior of the connecting pipe near said elbow section is provided with a protrusion to which the spring is grippingly secured.

8. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means; and (b) the connecting pipe is provided with a union flange insertable into the union portion of the housing, said union flange being arranged to sealingly engage said gasket means at an upstream face thereof.

9. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means; and (b) the closure member of the shut-off valve is provided with an upstream directed protrusion to which the spring is grippingly secured.

10. A tap according to claim 1 or 2, wherein:

(a) the connecting pipe is provided with union flange insertable into the union portion of the housing, said union flange being arranged to sealingly engage said gasket means at an upstream face thereof; and (b) the closure member of the shut-off valve is provided with an upstream directed protrusion to which the spring is grippingly secured.

11. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket member;

(b) the connecting pipe is provided with a union flange insertable into the union portion of the housing, said union flange being arranged to sealingly engage said gasket means at an upstream face thereof; and (c) the closure member of the shut-off valve is provided with upstream directed protrusion to which the spring is grippingly secured.

12. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means; and (b) the connecting pipe includes an elbow section, the spring being disposed within a downstream end of the connecting pipe and abutting against said connection pipe at the interior thereof near the elbow section.

13. A tap according to claims 1 or 2, wherein:

(a) the connecting pipe is provided with union flange insertable into the union portion of the housing, said union flange being arranged to sealingly engage said gasket means at an upstream face thereof; and (b) the connecting pipe includes an elbow section the spring being disposed within a downstream end of the connecting pipe and abutting against said connection pipe at the interior thereof near the elbow section.

14. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means;

(b) the connecting pipe is provided with a union flange insertable into the union portion of the housing, said union flange being arranged to sealingly engage said gasket means at an upstream face thereof; and (c) the connecting pipe includes an elbow section, the spring being disposed within a downstream end of the connecting pipe and abutting against said connection pipe at the interior thereof near the elbow section.

15. A tap according to claim 1 or 2, wherein:

(a) the closure member of the shut-off valve is provided with an upstream directed protrusion to which the spring is grippingly secured; and (b) the connecting pipe includes an elbow section, the spring being disposed within a downstream end of the connecting pipe and abutting against said connection pipe at the interior thereof near the elbow section.

16. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means;

(b) the closure member of the shut-off valve is provided with an upstream directed protrusion to which the spring is grippingly secured; and (c) the connecting pipe includes an elbow section, the spring being disposed within a downstream end of the connecting pipe and abutting against said connection pipe at the interior thereof near the elbow section.

17. A tap according to claims 1 or 2, wherein:

(a) the connecting pipe is provided with union flange insertable into the union portion of the housing said union flange being arranged to sealingly engage said gasket means at an upstream face thereof;

(b) the closure member of the shut-off valve is provided with an upstream directed protrusion to which the spring is grippingly secured; and (c) the connecting pipe includes an elbow section, the spring being disposed within a downstream end of the connecting pipe and abutting against said connection pipe at the interior thereof near the elbow section.

18. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means;

(b) the connecting pipe is provided with a union flange insertable into the union portion of the housing, said union flange being arranged to sealingly engage said gasket means at an upstream face thereof;

(c) the closure member of the shut-off valve is provided with an upstream directed protrusion to which the spring is grippingly secured; and (d) the connecting pipe includes an elbow section, the spring being disposed within a downstream end of the connecting pipe and abutting against said connection pipe at the interior thereof near the elbow section.

19. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means;

(b) the connecting pipe includes an elbow section, the spring being disposed within a downstream end of the connecting pipe and abutting against said connection pipe at the interior thereof near the elbow section; and wherein the interior of the connecting pipe near said elbow section is provided with a protrusion to which the spring is grippingly secured.

20. A tap according to claims 1 or 2, wherein:

(a) the connecting pipe is provided with union flange insertable into the union portion of the housing, said union flange being arranged to sealingly engage said gasket means at an upstream face thereof;

(b) the connecting pipe includes an elbow section, the spring being disposed within a downstream end of the connecting pipe and abutting against said connection pipe at the interior thereof near the elbow section; and (c) the interior of the connecting pipe near said elbow section is provided with a protrusion to which the spring is grippingly secured.

21. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means;

(b) the connecting pipe is provided with a union flange insertable into the union portion of the housing, said union flange being arranged to sealingly engage said gasket means at an upstream face thereof;

(c) the connecting pipe includes an elbow section, the spring being disposed within a downstream end of the connecting pipe and abutting against said connection pipe at the interior thereof near the elbow section; and (d) the interior of the connecting pipe near said elbow section is provided with a protrusion to which the spring is grippingly secured.

22. A tap according to claim 1 or 2, wherein:

(a) the closure member of the shut-off valve is provided with an upstream directed to protrusion to which the spring is grippingly secured;

(b) the connecting pipe includes an elbow section, the spring being disposed within a downstream end of the connecting pipe and abutting against said connection pipe at the interior thereof near the elbow section; and (c) the interior of the connecting pipe near said elbow section is provided with a protrusion to which the spring is grippingly secured.

23. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means;

(b) the closure member of the shut-off valve is provided with an upstream directed protrusion to which the spring is grippingly secured;

(c) the connecting pipe includes an elbow section, the spring being disposed within a downstream end of the connecting pipe and abutting against said connection pipe at the interior thereof near the elbow section; and (d) the interior of the connecting pipe near said elbow section is provided with a protrusion to which the spring is grippingly secured.

24. A tap according to claims 1 or 2, wherein:

(a) the connecting pipe is provided with union flange insertable into the union portion of the housing said union flange being arranged to sealingly engage said gasket means at an upstream face thereof;

(b) the closure member of the shut-off valve is provided with an upstream directed protrusion to which the spring is grippingly secured;

(c) the connecting pipe includes an elbow section, the spring being disposed within a downstream end of the connecting pipe and abutting against said connection pipe at the interior thereof near the elbow section; and (d) the interior of the connecting pipe near said elbow section is provided with a protrusion to which the spring is grippingly secured.

25. A tap according to claim 1 or 2, wherein:

(a) the upstream end portion of the compensating sleeve is provided with an annular peripheral protrusion for engagement with a complementary groove provided in the gasket means for maintaining a locking engagement between the compensating sleeve and the gasket means;

(b) the connecting pipe is provided with a union flange insertable into the union portion of the housing, said union flange being arranged to sealingly engage said gasket means at an upstream face thereof;

(c) the closure member of the shut-off valve is provided with an upstream directed protrusion to which the spring is grippingly secured;

(d) the connecting pipe includes an elbow section, the spring being disposed within a downstream end of the connecting pipe and abutting against said connection pipe at the interior thereof near the elbow section; and (e) the interior of the connecting pipe near said elbow section is provided with a protrusion to which the spring is grippingly secured.

* * * * *